US006007237A

United States Patent [19]

Latto

[11] Patent Number: 6,007,237

[45] **Date of Patent: *Dec. 28, 1999**

[54] VORTEX RING MIXER CONTROLLED MIXING DEVICE

[76] Inventor: Brian Latto, 153 Valley Road, RR2, Dundas, Ontario, Canada, L9H 5E2

[ * ] Notice: This patent issued on a continued prosecution application filed under 37 CFR 1.53(d), and is subject to the twenty year patent term provisions of 35 U.S.C. 154(a)(2).

[21] Appl. No.: 08/865,352

[22] Filed: May 29, 1997

[51] Int. Cl.[6] ..... B01F 11/00

[52] U.S. Cl. ..... 366/315; 366/332

[58] Field of Search ..... 366/332, 267, 366/255, 256, 349, 262, 269, 275, 334, 315, 316

[56] References Cited

U.S. PATENT DOCUMENTS

| | | | |
|---|---|---|---|
| 198,554 | 12/1877 | White | 366/332 |
| 291,890 | 1/1884 | Flanders | 366/256 |
| 419,127 | 1/1890 | Kallen | 366/255 |
| 568,005 | 9/1896 | Stukes | 366/256 |
| 569,718 | 10/1896 | Kennedy | 366/267 |
| 763,139 | 6/1904 | Yarbarough | 366/256 |
| 1,175,366 | 3/1916 | Lucas | 366/332 |
| 1,211,426 | 1/1917 | Farrington | 366/332 |
| 1,345,312 | 6/1920 | Blake | 366/332 |
| 1,408,596 | 3/1922 | Heinrich | 366/332 |
| 2,020,638 | 11/1935 | Feltault | 366/332 |
| 2,281,094 | 4/1942 | Chambers | 366/332 |
| 2,486,126 | 10/1949 | Dahnke | 366/256 |
| 2,615,692 | 10/1952 | Muller | 366/332 |
| 2,661,938 | 12/1953 | Kuentzel | 366/332 |
| 2,713,867 | 7/1955 | Longan | 366/332 |
| 2,780,444 | 2/1957 | Hickey . | |
| 3,313,240 | 4/1967 | Bentov | 366/275 |
| 3,912,237 | 10/1975 | Ostberg et al. | 366/332 |
| 4,067,551 | 1/1978 | Reilly . | |
| 4,732,487 | 3/1988 | Pollard | 366/332 |
| 5,052,813 | 10/1991 | Latto | 366/267 |
| 5,100,242 | 3/1992 | Latto | 366/267 |
| 5,252,301 | 10/1993 | Nilson et al. | 366/255 |

FOREIGN PATENT DOCUMENTS

| | | | |
|---|---|---|---|
| 1314041 | 2/1993 | Canada . | |
| 2013558 | 6/1997 | Canada . | |
| 283307 | 9/1988 | European Pat. Off. . | |
| 553 709 A1 | 8/1993 | European Pat. Off. . | |
| 2 605 244 | 4/1988 | France . | |
| 76323 | 12/1917 | Switzerland | 366/256 |
| 1298573 | 12/1972 | United Kingdom | 366/332 |

*Primary Examiner*—Tony G. Soohoo

*Attorney, Agent, or Firm*—Evenson, McKeown, Edwards & Lenahan, P.L.L.C.

[57] ABSTRACT

A method and apparatus is disclosed for controlled mixing or agitation of fluids and slurries using the generation and propagation of vortex rings. The vortex rings are generated from a generator plate. The novelties are a central drive shaft which moderates the behavior of the vortex rings, the driving of the generator plate through a drive spider from the drive shaft which can also moderate the behavior of the vortex rings, the addition of flexible generator plates to enhance the scope of mixing and material selection, the addition of contoured generator plates, and the addition of plate disruptors which permits the controlled dissemination vortex rings. Furthermore the use of a hollow drive shaft with selected orifices or nozzles permits the controlled introduction and extraction of material from the fluid being mixed while the apparatus is in motion. This also permits an agitation system which is basically self contained.

16 Claims, 9 Drawing Sheets

VORTEX RING MIXER CONTROLLED MIXING DEVICE

FIELD OF THE INVENTION

This invention relates to an apparatus for the mixing of fluids and, in particular, to an apparatus for the generation and control of vortex rings in a fluid, and also the controlled addition and extraction of fluid from the bulk of the fluid being mixed.

BACKGROUND OF THE INVENTION

Many different types of fluid mixing apparatus have been produced in the past and, although most work relatively well, some require high energy inputs or high energy input per unit volume of the fluid being mixed. Others are often relatively inefficient and have limitations to applications. The problem is particularly acute in connection with the mixing of stratified fluid or solid/liquid suspensions or slurries.

One type of device used in the past works on the principle that a fluid vortex ring generated in the fluid will propagate through the fluid, even if it is stratified. Thus it will produce effective mixing by the transfer of mass as parcels of fluid and also create fluid motion or convection within the bulk of the fluid being mixed. That is, by impulsively moving a generator plate, having an orifice, in a controlled manner, fluid is ejected through the orifice and becomes a vortex ring.

A vortex ring is a toriodal rotating mass of fluid which has an overall oblate spheroid shape. A vortex ring efficiently transfers fluid from it's generating location to a distant location in a fluid to be mixed. Thus, mass is transferred and, when this takes place, movement of the surrounding fluid (mass convection) also takes place. Vortex rings can be highly energetic and when they impact a solid boundary cause considerable disturbance and turbulence. This is particularly useful for the agitation of sedimented slurries when an impacting vortex ring will cause dispersion of the sedimented materials. This results in low mixing times and low energy inputs, while producing homogeneity of the fluid being mixed.

Apparatus for generating vortex rings in a fluid which creates mixing of that fluid is described in the following patents issued to the present inventor: U.S. Pat. No. 5,100,242; U.S. Pat. No. 5,052,813; Canadian Patent No. 1314041; Canadian Patent Application No. 2,013,558; and European Patent No. 0 283 307B1. While the devices described in these patents work very well, a problem that sometimes occurs in the use of these devices is that a vortex ring generated on the upper surface of the generating plate is often too energetic when it reaches the free surface of the liquid. This can result in gas or air entrainment which is often undesirable. It also can result in undesirable foaming of the fluid at the surface and can cause excessive splashing. It also reduces the efficiency of the mixing because the mass of fluid within the vortex ring is not properly dissipated and distributed at the surface. The energetic breaking of the surface of the liquid results in localized turbulence whereas controlled destruction of a vortex ring, either during its forward progress or at a location just prior to the free surface, can result in highly augmented fluid circulation. This is also applicable to vortex rings energetically impacting a solid boundary, such as the base of mixing vessel, which may be useful for highly sedimented slurries etc. but may be inefficient for non-sedimentary fluid when the gradual destruction and dissipation of the material in a vortex ring is desirable.

SUMMARY OF THE INVENTION

In one aspect the present invention provides an improved vortex ring mixer for mixing fluids comprising a reciprocating central drive shaft to which is secured a generator plate having an orifice for generating vortex rings, drive means for the drive shaft, the diameter of the drive shaft being such that it disrupts the vortex rings generated by the mixer to promote increased mixing.

In another aspect, the invention provides an improved vortex ring mixer as described above wherein the mixer includes means for disrupting vortex rings. In another aspect, there is provided a mixer which includes means for adding material to be mixed or removing material from the fluid.

DEFINITIONS

A "vortex ring" is a toriodal parcel of rotating fluid with the overall shape of an oblate spheroid or flattened sphere, with an internal structure somewhat similar to a ring doughnut. Due to its shape and the fact that it is rotating, a vortex ring rolls through the surrounding fluid and the relative velocity of its outer surface relative to the fluid through which it is passing approaches zero. Therefore, the surface shear rate is very low and the viscous drag on the translational motion of a vortex ring is very low. Furthermore, the flow around the vortex ring results in ingestion of ambient fluid into it at its down stream face and some expulsion of fluid at this face which produces a self induced reduction in the pressure differential between the front and back of the ring, thus reducing the form drag on the vortex ring. These factors indicate why a vortex ring can travel considerable distance after it has been generated.

- 'c' is the inside diameter of an annular type disruptor plate.
- 'D' is the outside diameter of the generator plate.
- 'd' is the diameter of the orifice in the generator plate.
- 'dr' is the diameter of the drive shaft.
- 'da' is the diameter of the location of the apex on a contoured generator plate.
- 'Dd' is the outside diameter of a disrupter plate.
- 'L' is the distance from the plane of the orifice at which the drive shaft commences.
- 's' is the stroke of the generator plate. That is the distance a generator plate moves in half a cycle of the generator plate.
- 'Vd' is the volume displaced by the generating generator plate when moved through stroke 's'. Therefore, $Vd=(D^2/4)s$
- 'Ve' is the volume of that portion of the fluid displaced by the generating generator plate when moved through stroke 's' which is ejected through the orifice. Ve is equal to a fraction of the displaced volume Vd, and depends on the amount of fluid which is ejected radially from the generating plate. This is to some extent determined by the type of generator plate and the geometric shape of the generator plate.
- 'Vf' is the volume of that portion of the fluid displaced by the generating generator plat when moved through stroke 's' which is ejected from the outer diameter of the generator plate.
- 'X' is the distance a disrupter plate is located from the plane of the orifice.
- 'η' is the fraction of the displaced volume of fluid Vd which is ejected through the orifice. That is $Ve=\eta Vd=\eta(\pi D^2/4)s$.

'Le' is the equivalent length of fluid which is ejected from the generating orifice having a diameter 'd'. Thus $Le=Ve/(\pi d^2/4)=\eta\ Vd/(\pi d^2/4)$.

'$\epsilon$' is the ratio of Le/d and a useful parameter for determining the effectiveness of the generator plate. Since $Le=Ve/(\pi d^2/4)$, $Ve=\eta\ Vd$, and $Vd=(\pi D^2/4)s$, then $\epsilon=Le/d=\eta(D/d)^2 s/d$.

BRIEF DESCRIPTION OF THE DRAWINGS

FIGS. 4*a* to 4*g* show the three basic forms of flexible generator plate attachment at various annular locations, while FIG. 4*a* shows a flexible generator plate made up of flexible leaves;

DETAILED DESCRIPTION OF THE INVENTION

The present invention is an improvement to the devices described in the above-mentioned patents in that the individual or collective use of a central drive shaft or shafts, projections or destructor devices at strategic locations on the shafts, a hollow drive shaft with facilities for the addition of substance to the material being mixed or removal of substance from the material being mixed, flexible generator plates, and contoured generator plates can enhance and control a mixing process being achieved using vortex ring generation and transport and can provide a structurally simplistic, lighter drive arrangement, which has a wide application with greater commercial potential than the prior vortex ring devices.

Figure 1A:
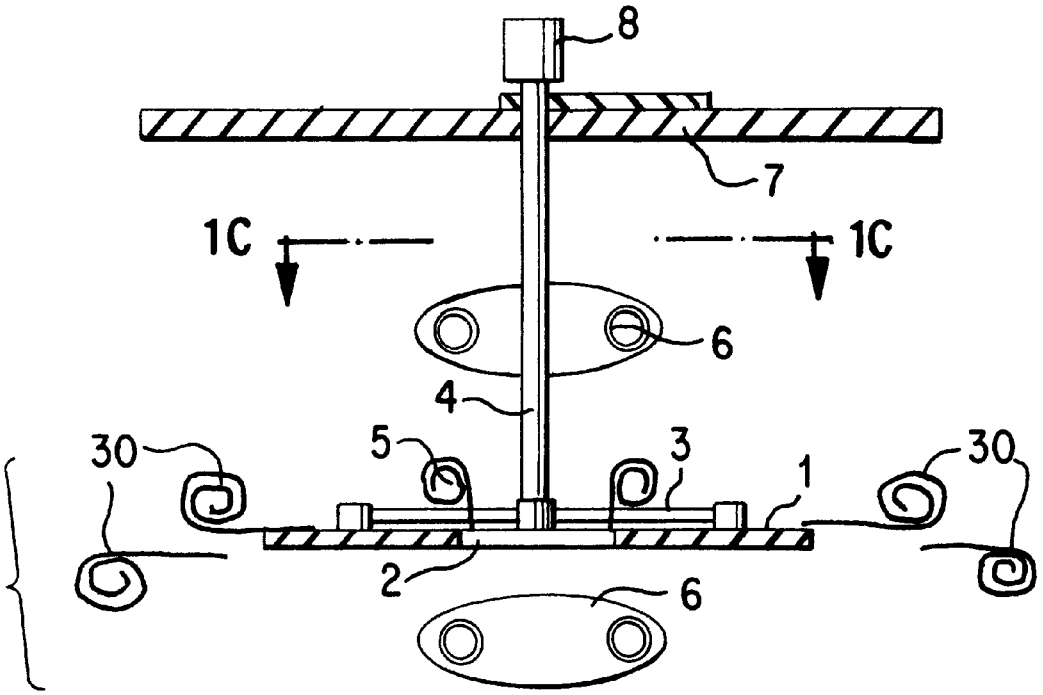
FIGS. 1*a* to 1*d,* show elevational views and a plan view, partly in section, of a preferred embodiment of a single plate vortex ring generator with a central drive shaft having any geometric cross section, showing the drive spider and generator plate, both directly attached or integral and alternatively indirectly attached to each other, the generation of a vortex ring through the orifice, and the generation of a ring vortex from the outer edge of the generator plate, according to the present invention.
Figure 1B:
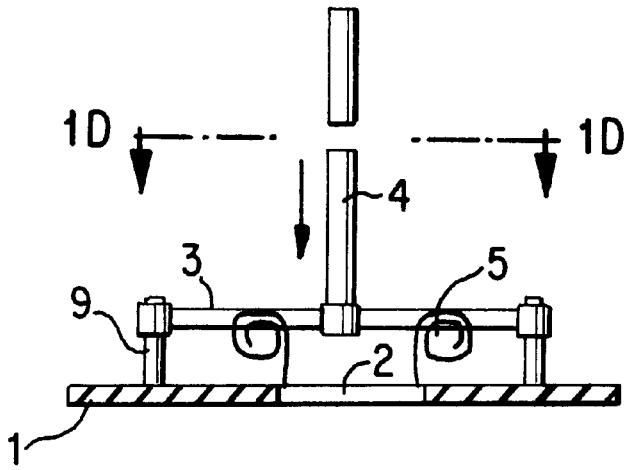
Figure 1C:
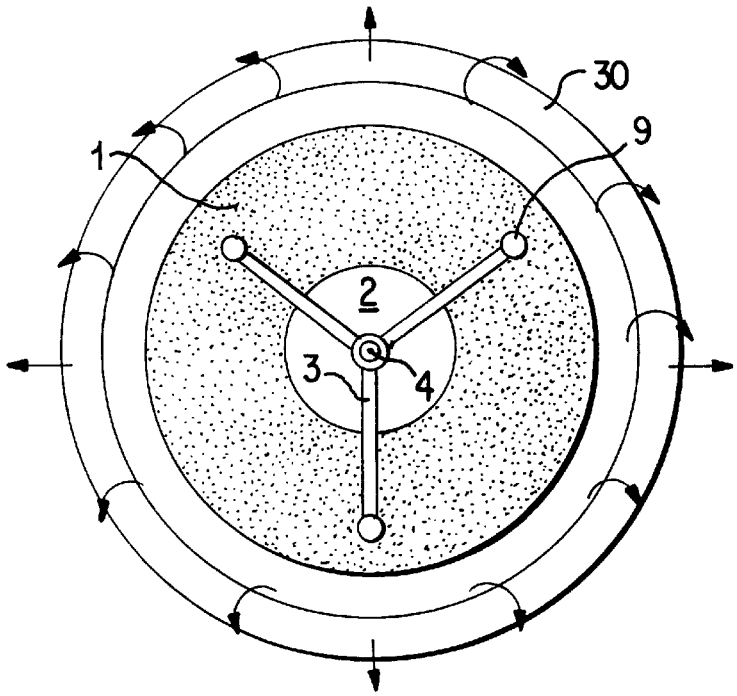
Figure 1D:
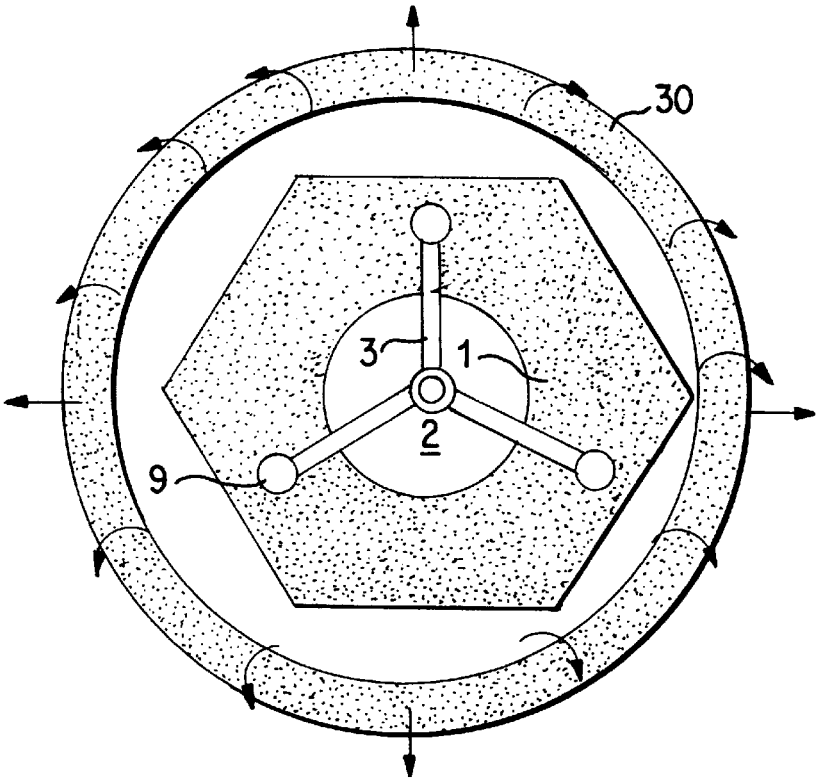

The central drive shaft improvement to the mixer is shown in FIG. 1*a* where the central drive shaft 4 is directly connected to the vortex ring generating generator plate 1, having an orifice 2, by a drive spider 3. The drive spider may have any number of arms from one to many, with the reservation being the balance of the physical strength required for their duty with the destructive effect on the vortex ring. The central drive shaft is reciprocated by a drive 8 of any type capable of producing the required motion and the whole is supported from a mounting 7. The central drive shaft(s) can extend from the motion generating motor to or even through the plane of the vortex ring generating generator plate where it connects directly with a spider which is integral with or mounted directly on the generator plate as in FIG. 1*a,* or it can extend only partially from the drive to a spider which connects indirectly with the generator plate through legs 9 pitched on a diameter greater than that of the vortex rings as in FIG. 1*b.* Thus, the central drive shaft can be arranged such that its diameter controls the rate of deceleration of the vortex ring and its position defines the point at which such control commences. The legs attaching the spider (3) to the generator plate (1) may be of fixed length or of adjustable length for fine tuning the control over the mixing.

Figure 2A:
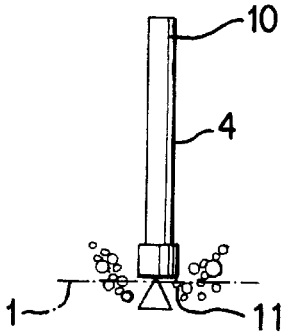
FIGS. 2*a* to 2*i* show the various types of drive shafts with injection and/or extraction orifices or ports.

The central drive shaft 4 may be hollow or solid as good design allows but a hollow shaft 4 as depicted in FIG. 2*a* allows for the use of the shaft 4 for the addition or removal of substance through the shaft 4 via the supply or extraction line 10 and supply or extraction orifice(s) 11,15 and 16.

Figure 2B:
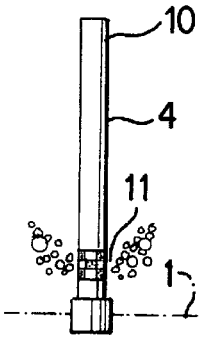
Figure 2C:
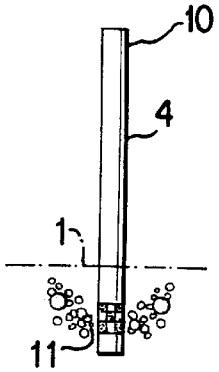
Figure 2D:
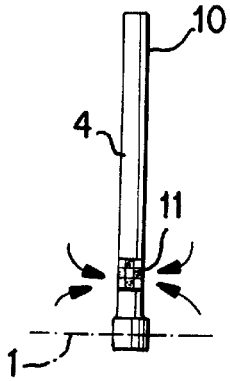
Figure 2E:
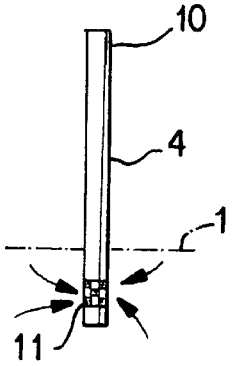
Figure 2F:
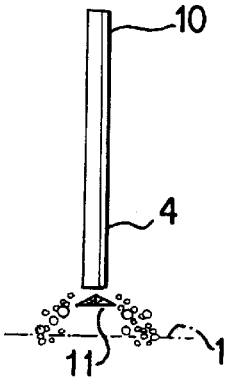
Figure 2G:
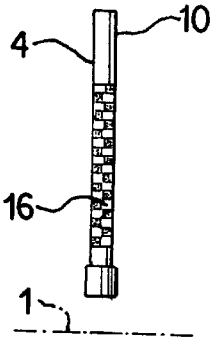
Figure 2H:
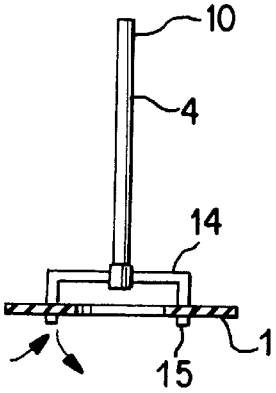
Figure 2I:
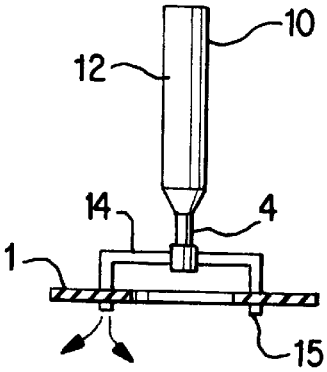

FIG. 2*a* shows substance added through an orifice(s) 11 at the end of the central drive shaft 4 FIG. 2*b* shows addition of a gaseous or fluid substance above the generator plate 1, while FIG. 2*c* shows addition below the generator plate 1. Fluid can likewise be removed through similar orifices and FIGS. 2*d* and 2*e* show arrangements with fluid being removed. FIG. 2*f* shows granular material being added while FIGS. 2*h* and 2*i* show that substance can be added or removed through the hollow drive shaft via a hollow spider 14 and inlet or outlet orifice(s) 15. FIG. 2*g* shows a perforated hollow drive shaft 16.

FIG. 3 shows a variety of modifications and additions to the central drive shaft 4 which can be used to moderate the vortex ring behavior and thereby the mixing.

Figure 3A:
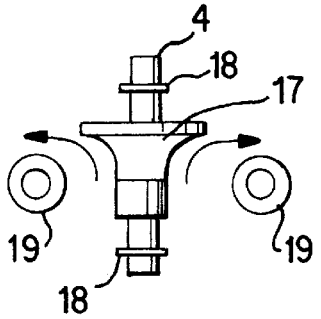
FIGS. 3*a* to 3*k* and FIGS. 3*m* to 3*p* show the various forms of vortex ring disruptors.
Figure 3B:
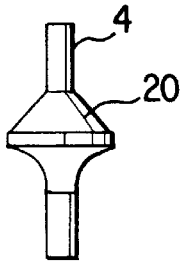
Figure 3C:
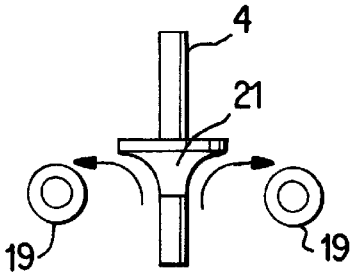
Figure 3D:
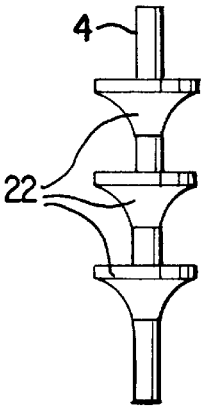
Figure 3E:
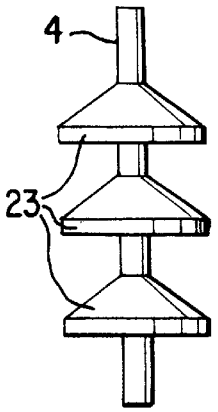
Figure 3F:
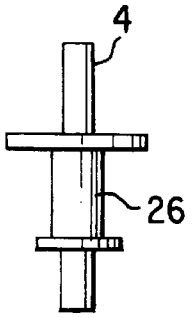
Figure 3G:
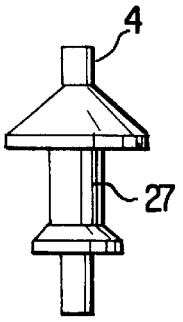

FIG. 3*a* shows a restrained disrupter 17 which is free to slide along the shaft 4 between restraining stops 18. FIG. 3*b* shows a contoured disrupter 20 with a downwardly sloping upper surface which will shed material rather than allow it to accumulate. FIGS. 3*c* illustrates a disrupter 21 with a flat upper surface. FIGS. 3*d* and 3*e* show multiple disruptors 22 and 23 while FIGS. 3*f* and 3*g* show progressive disruptors 26 and 27.

Figure 3H:
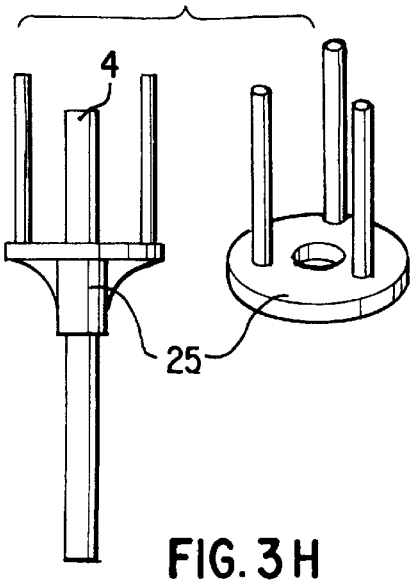
Figure 3I:
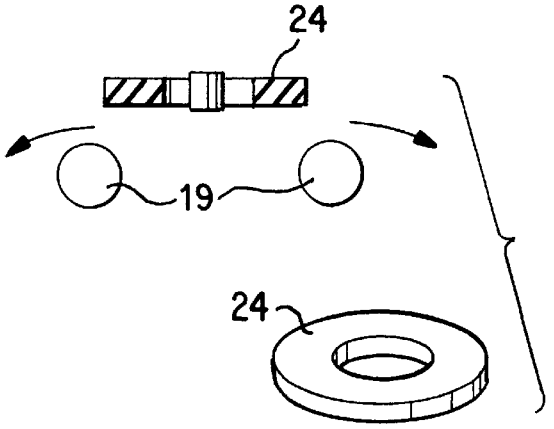
Figure 3J:
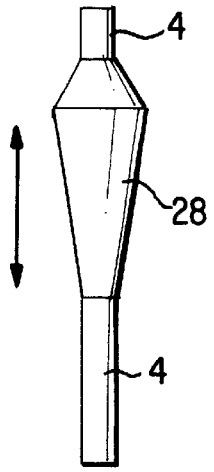
Figure 3K:
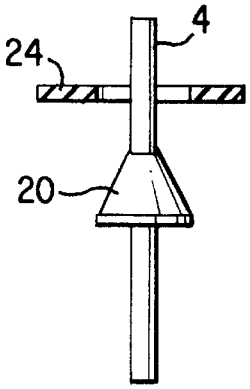
Figure 3M:
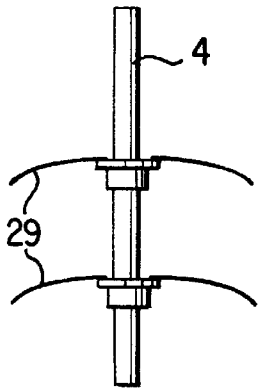
Figure 3N:
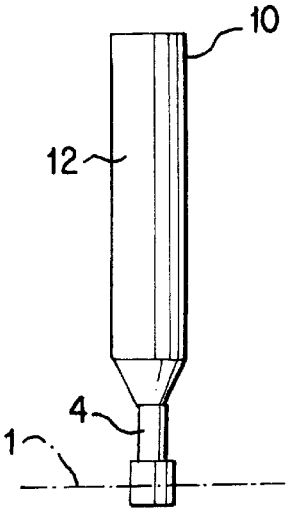
Figure 3O:
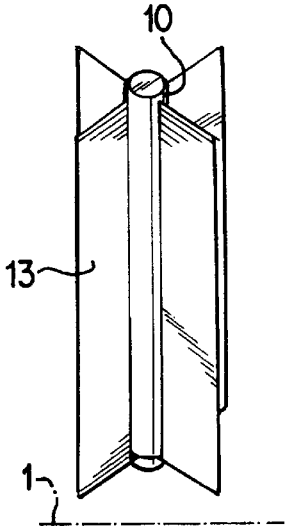

FIG. 3*h* shows an externally mounted disrupter 25 through which the central drive rod is free to reciprocate. FIG. 3*i* shows a buoyant disrupter 24 which is meant to float with a top surface of the fluid. This could include a top view. FIG. 3*j* shows a solid body disruptor 28 mounted on the drive shaft 4. FIG. 3*k* shows a compound disruptor using in this case a fixed contoured disruptor 20 and a buoyant disruptor 24. FIG. 3*m* shows flexible disruptors. FIGS. 3*n* and 3*o* show an enlarged drive shaft 12 and a finned drive shaft 13 respectively.

Any combination of central drive shaft, whether solid, hollow, enlarged or finned and disrupter, whether fixed, restrained, contoured or plain, or of positive neutral or negative buoyancy can be combined as the application requires.

FIG. 4 shows the flexing of a flexible generator plate 31 about a toroidal ring 32 upon which it is mounted. FIGS. 4*a* and 4*b* show the inner mounting, 4*c* and 4*d* show intermediate mounting positions and 4*e* and 4*f* show the mounting at the outer diameter of the plate 31.

Figure 4A:
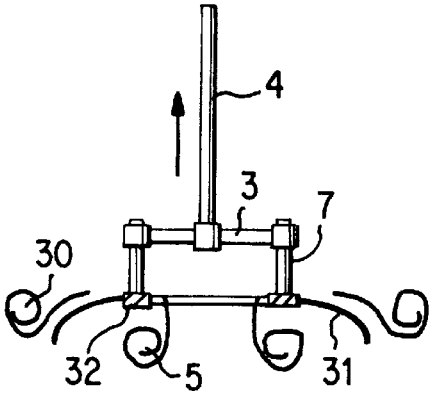
Figure 4B:
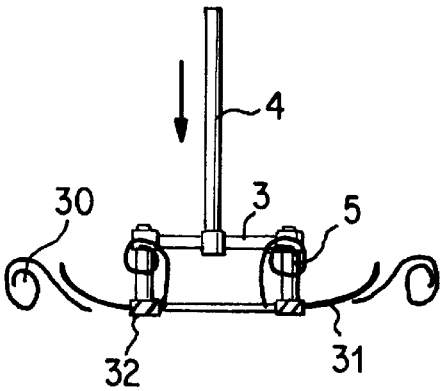
Figure 4C:
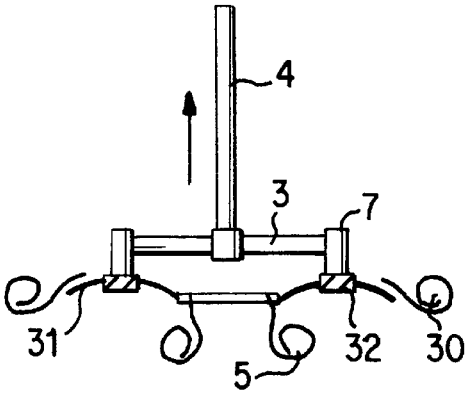
Figure 4D:
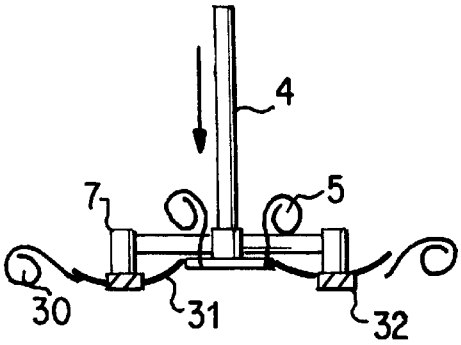
Figure 4E:
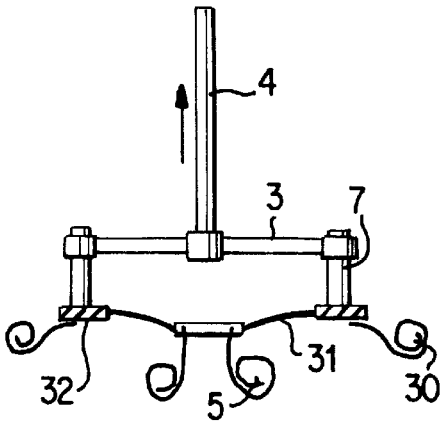
Figure 4F:
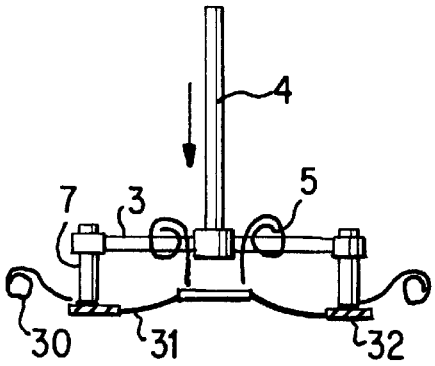
Figure 4G:
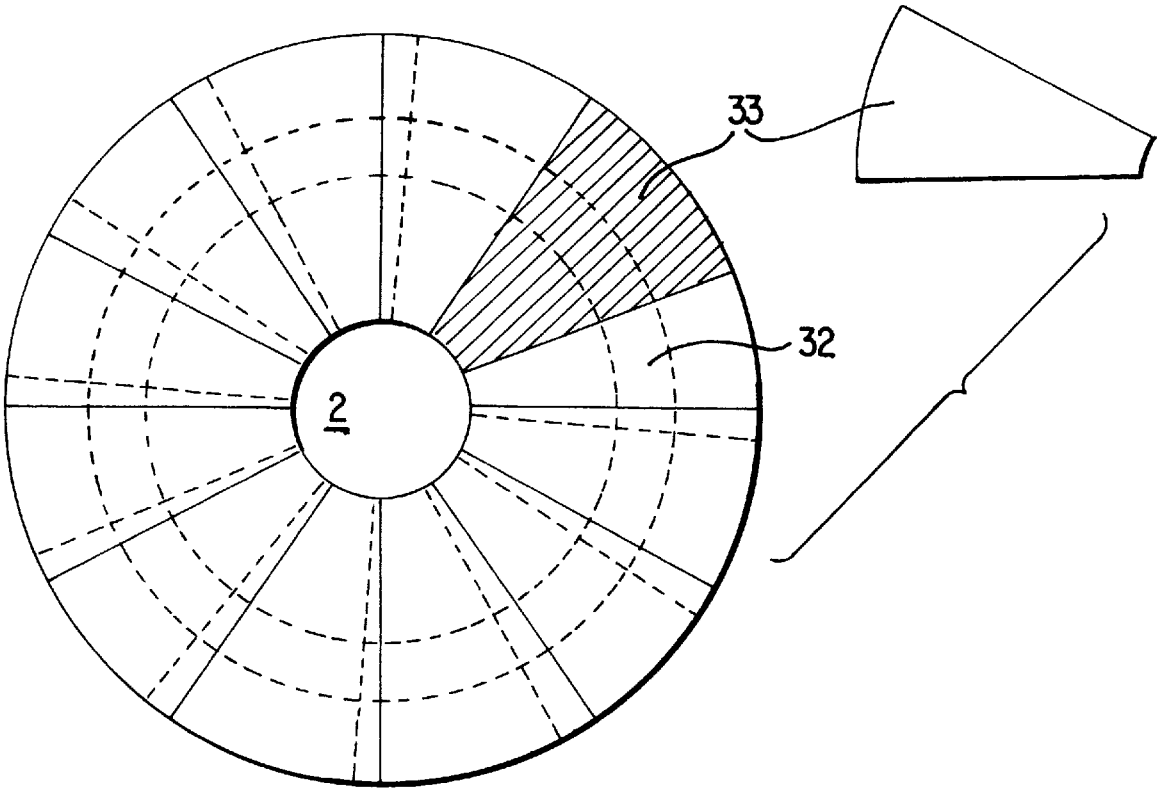

FIG. 4*g* shows the flexible generator plate made up of individual flexible leaves 33 which can be mounted on the toroidal ring 32 in any fashion, for example as with the flexible generator plates shown in FIGS. 4*a* through 4*f.*

Figure 5A:
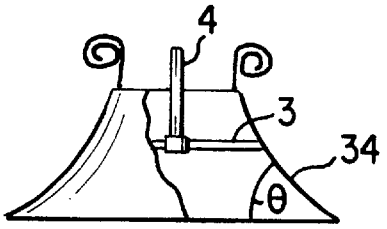
FIGS. 5*a* to 5*d* show the generator plate with contoured geometric configurations in views from one extreme, to typical, to the other extreme.

The conical generator plate 34 shown in FIG. 5*a* may have contoured or flat sides at various angles θ. The contoured generator plate 35 shown in FIG. 5*b* has both sides equally contoured but this is not essential and in practice each side of the generator plate 35 can be contoured or not and different if necessary.

In operation, the central drive shaft(s) improvement as shown in FIG. 1 has the objective of the control of the motion and propagation of the generated vortex rings 6 in order to enhance the mixing process, to reduce surface air or gas entrainment, and to reduce energy consumption.

Vortex rings 5 generated at an orifice will normally travel away from the generating generator plate 1 in a direction which is basically normal to the plane of the generating orifice 2, as depicted in FIG. 1*a*. Although, a vortex ring 6 may stray from this particular direction due to a number of effects such as, turbulence in the flow field ahead of the vortex ring 6, instability of the vortex ring 6, and effects of an adjacent wall or objects, it will otherwise continue to travel until devoid of energy or until it meets an obstruction, stratification layer, or fluid interface with sufficient resistance to cause its destruction . However, it is not always desirable to have the vortex ring continue on a straight path to a fluid stratification layer, interface or surface energetically, since it may result in a relatively vigorous breakup at the layer, interface or surface of the fluid with resulting unwanted mixing or the inclusion of surface gases, and can result in reduced efficiency of mixing because it is often desirable to have radial dispersion of a vortex ring when it reaches a boundary or liquid-gas interface (free surface).

According to one aspect of the invention, there is provided a central drive shaft(s) 4 located on the central normal axis of the vortex ring generating generator plate 1. The generating plate 1 as described in prior inventions cited above is a plate with one or more generating orifices 2 in it. The central drive shaft 4 is driven in a reciprocating fashion by a drive 8 supported by a mounting 7, either of which can be located at any convenient point or out of the vertical plane providing the motion is appropriate for the propagation of vortex rings and that the mounting is stable.

In this improved vortex ring mixing device the drive shaft(s) 4 is centrally located with respect to the generating orifice 2, such that a vortex ring 5 generated at the orifice 2 then normally travels away from the orifice 2 along and parallel to the drive shaft 4. The effect of the drive shaft diameter 'dr' is to cause internal friction within the vortex ring 6 which is traveling along the drive shaft. This will cause the vortex ring 6 to incur frictional drag due to interaction with the solid boundary of the drive shaft 4 which will result in a decrease in the forward velocity of the vortex ring 6 and cause it to decelerate more rapidly than otherwise would happen. This in turn results in an increased discharge from the vortex ring 6 in its wake. Thus, depending upon the relative size 'dr' of the drive shaft 4 compared with the diameter (d) of the generating orifice 'dr', vortex rings 6 may be controlled such that they can be allowed to vigorously break, to just break, or to break before a liquid-gas interface, surface or other boundary. The enhanced wake and gentle destruction of the vortex ring 6 at the surface will result in greatly enhanced flow convection and enhanced mixing compared with drive shafts 4 which do not interact with the vortex ring 6.

When a vortex ring 6 encounters the drive shaft 4 it expands and decelerates and will most likely transform into a turbulent structure if it is originally laminar in structure. Thus if the encounter with a drive shaft 4 is delayed, a vortex ring 6 can be made to travel slightly longer distances when using a central drive shaft 4. This can be achieved by attaching the drive spider 3 to generator plate 1 by of means of legs 9 as in FIG. 1*b*. These legs 9 can be adjustable or fixed in length such that the control of a vortex ring 6 by the central drive rod 4 occurs only at the required point of travel.

Referring to FIGS. 2, a preferred embodiment is a central drive shaft 4 vortex ring mixer having various drive shafts 4, with various addition or extraction nozzles and/or orifices 11, 15, and 16. The generator plate is attached to the drive shaft 4 either directly or indirectly by legs 9 to the support spider 3. The various locations of the orifices 11, 15, 16 are to permit particular mixing processes or the extraction from specific regions of the fluid being mixed. Fluid or gaseous substance may be added to the fluid being mixed through the supply line 10 via the hollow drive shaft through the orifice(s) 11 as in FIGS. 2*a, b, c,* and *e,* the perforated drive shaft 16 as in FIG. 2*g,* or by using a hollow drive shaft 4, a hollow drive spider 14 and orifices 15 as shown in FIGS. 2*h* and 2*i* where the supplied substance exits on the underside of the generator plate 1. FIG. 2*f* shows that other nozzle or orifice designs can accommodate granular material while FIG. 2*d* shows that fluid can equally well be extracted through similar orifices.

By adding a substance at or near the site of the forming vortex ring 5 the substance will be carried by the vortex ring 6 and efficiently mixed and distributed during the mixing process. Being able to determine whether to add, or extract, at the plane of the generator plate, below it or above it allows for the substance to be carried by the vortex rings 6 generated from both sides of the generator plate 1 or predominantly by one side only. This is useful in gasification or aeration scenarios where the gas or air should preferably be driven down as opposed to up.

According to another aspect of this improvement, the control exercised by the central drive shaft can be enhanced by the addition of vortex ring disruptors. Various fixed disruptors 21 can be attached to the drive shaft as in FIG. 3*c,* externally mounted disruptors 25 can be attached directly or indirectly to the mounting of the mixer as in FIG. 3*h,* disruptors which are free to move along the drive shaft as with the restrained disruptors 17 within defined limits between restraining stops 18 as shown in FIG. 3*a* and buoyant disruptors 24 as in FIG. 3*i*. The location of a disrupter will disrupt vortex rings 19 as in FIGS. 3*a*, 3*c* and 3*i* and will affect the forward motion either by decelerating them and causing them to expand in diameter with reduced forward velocity, or cause the vortex rings to expand rapidly and radially to dissipate entirely or to encounter a mixing vessel wall where then it will reverse direction. Any sliding disruptor(s) can have neutral, negative or positive buoyancy depending on the particular mixing operation. Disruptors can be rigid or flexible, solid or hollow, or have an annular ring or toriodal shape. The flexible disrupter 29 shown in FIG. 3*m* enhances mixing by inducing vortex rings generated at a plate 1 to gently dissipate when they encounter it, and also generate radial vortex rings which will radiate radially from the disruptor in a fashion similar to that depicted for the flexible generator plate in FIGS. 4. The flexible disruptors will also have a lower drag on the drive shaft 4 than a rigid disrupter.

Buoyant disruptors 24 which are constrained to move parallel to the drive shaft and which have some buoyancy or will float permits the location of disruptors adjacent to or just below the surface of the liquid being agitated. These floating disruptors will move with the liquid surface and are, therefore, suited for when the volume or surface level of the liquid being agitated rises or falls such as when the liquid is supplied or discharged.

Restrained disruptor(s) 17 which can slide along the drive shaft within a constrained length, such that they cannot slide down the shaft beyond a certain prescribed location reduce friction loss and, therefore, drive shaft losses which would occur when a disruptor is fixed on the drive shaft, but still provides a disruptor to terminate the forward progress of a vortex ring and create radial dispersion and thereafter convective flow. The diameter Dd of a disruptor and its location X along the drive shaft 4 has a notable affect on the motion and direction of a vortex ring. Since the diameter dr of the drive shaft has an affect on the progress and motion of a vortex ring, a tapered or enlarged drive shaft 12 as in FIG. 3*n* or a modified drive shaft such as the finned drive shaft 13 in FIG. 3*o* is desirable in some applications, especially when the taper, enlargement or other modification is beneficial to the structural rigidity integrity of the drive shaft.

Disruptors, whether fixed or restrained or buoyant or externally mounted, can be deployed in multiple disruptor 22 and 23 arrangements as in FIGS. 3*d* and 3*e*, or can be combinations as with progressive disruptors 26 and 27 deployed in FIGS. 3*f* and 3*g*, or can be grouped together as in FIG. 3*k* which shows a fixed contoured disrupter 20 followed by a buoyant disruptor 24.

Figure 3P:
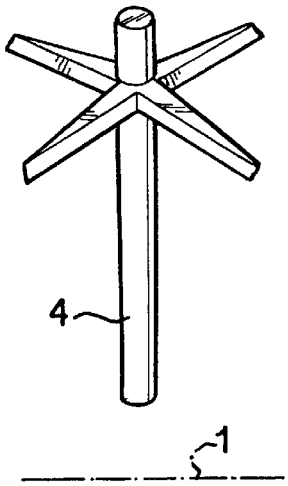

Disruptors attached to or around the drive shaft at strategic locations as depicted in FIGS. 3*a* through 3*p* will result in the destruction and/or gradual controlled dispersion of a vortex ring when the ring encounters a disrupter. The magnitude of the outer diameter or dimension Dd of the disruptor(s) will determine the result in either partial or full destruction of a ring. The disruptor 17 through 29 may be solidly attached to the drive shaft 4 as in FIGS. 3*b* and 3*c*, or may be able to slide along the drive shaft 4 as in FIG. 3*a*. When the disrupter 17 through 29 is able to slide along the shaft it is desirable to install stops 18 to avoid the disrupter falling to either ends of the shaft 4 or avoid excessive movement of the disruptor. A positively buoyant disruptor 24 floats on the surface of the liquid and is able to slide along the drive shaft 4. A stop 18 enhances the resistance of the disrupter to bounce on the liquid surface due to surface motion and/or the impact of an energetic vortex ring. This effect can be controlled by increasing the mass of a disruptor and thus creating an inertia affect when a vortex ring impacts the disrupter. Multiple disruptors as in FIGS. 3*d* and 3*e* provide a more gradual destruction of a vortex ring with smaller diameter disruptors rather than a sudden destruction with a single larger diameter disruptor. These disruptors 22, 23, 26, 27, 20 plus 24, and 29 can be fixed to the drive shaft 4 or able to slide along the drive shaft. When the disrupter 24 is an annular disc or shaped body it permits controlled destruction of a vortex ring when it impacts the disrupter. The annular geometry allows the vortex ring to decompose into two or more vortex rings which may carry past the disruptor and gently agitate the fluid above the disruptor. Thus, permitting controlled agitation above the disruptor. The disrupter may be fixed to the drive shaft or able to slide along the drive shaft.

A further arrangement employs contoured disruptors 20 as in FIG. 3*b* and 3*e* which can have a sloped upper face to avoid sediment build up on that face when sedimentary materials such as slurries are being mixed. Progressive distruptors 26 and 27 with progressively larger diameters are attached or able to slide on the drive shaft 4. This arrangement permits the controlled progressive dispersion of a vortex ring as it encounters the disruptors and, thus, controlled agitation of the fluid being mixed. It also controls the mixing in particular regions in the fluid. Alternatives to this arrangement include a solid body disruptor 28 as in FIG. 3*j* and a finned disruptor 13 as in FIG. 3*o*. Either of these disruptor arrangements may be fixed to the drive shaft or able to slide along the drive shaft.

An alternative disruptor system is similar to prior art but the disruptors are flexible 29. This avoid sediment buildup on the upper surface while also reducing the drag on the drive shaft. When attached to the drive shaft the flexible disruptors can create radial vortex rings 30 which enhance the mixing process.

Disruptors may be of various shapes for various requirements. FIG. 3*p* presents an example of an alternative form of disrupter which is basically a series of projections from the drive shaft. This type of disruptor will usually only partially disrupt a vortex ring, but depending on the thickness and number of projections can fully disrupt a vortex ring.

According to another aspect of the invention, flexible generator plates 31 are a preferred embodiment of the vortex ring mixer, as depicted in FIG. 4*a* through 4*f* FIGS. 4*a* and 4*b* present a flexible generator plate 31 which is attached to a support toroidal ring 32 at its inner radius. As the drive shaft goes through a complete cycle vortex rings 5 will be generated through the orifice, however the flexibility of the plate results in a considerable amount of the fluid traveling radially outwards and generating radial vortex rings 30. Thus for a relatively shallow mixing vessel the radial vortex rings become a considerable part of the mixing process and $\eta$ is relatively low.

FIGS. 4*c* and 4*d* show a flexible generator plate 31 in which the support toroidal ring 32 is at a diameter between the inner orifice diameter d and the outer generator plate diameter D. With this arrangement the plate flexes about this support ring and the flow is divided between the orifice and the outer periphery. Thus $\eta$ is larger than that value for when the plate is tethered at the inner radius as depicted in FIG. 4*a* and 4*b*.

FIGS. 4*e* and 4*f* show a flexible generator plate 31 in which the support toroidal ring 32 is at the outer peripheral diameter such that the majority of the flow passes thorough the orifice and approaches unity. Thus in this case a strong vortex ring 5 is generated and this arrangement is suitable for mixing vessels having a relatively large height to diameter ratio where a vortex ring will travel a considerable distance before dissipating at the surface.

FIG. 4*g* presents an alternative form of a flexible generator plate which is comprised of a series of elements like pie shaped flexible leaves 35. These may be relatively stiff or quite flexible. These elements are somewhat similar to an iris and allow the whole assembly to flex without undue rippling of the inner or outer edges. The support toriodal ring 32 may be located in any of the positions indicated for flexible generator plates shown in FIG. 4*a* through 4*f*.

Not only does the flexible generator plate 32 have decided values in improving the mixing process, but in combination with the central drive shaft it permits the insertion of a relatively large generator plate through a relatively small access hole.

An alternative aspect of the invention is various contoured generator plates. FIG. 5*a* shows a conical generator plate 34 which has a cone angle $\theta$ in the range $0 \leqq \theta \leqq 90°$. As $\theta$ increases from zero, $\eta$ increases and more fluid passes through the orifice and is ejected in the form of a vortex ring. This type of generator plate permits control of the mixing by acting as a form of diode in that more flow will pass through the orifice of the cone and form a vortex ring on the one stroke, down as shown in FIG. 5*a*, than on the reverse stroke when the fluid will tend to flow over the outer body to form a radial vortex ring. Thus if this type of device is placed in the bottom of a mixing vessel the mass transfer can be controlled such that it is primarily away from the device while still ensuring good mixing in all regions.

Figure 5B:
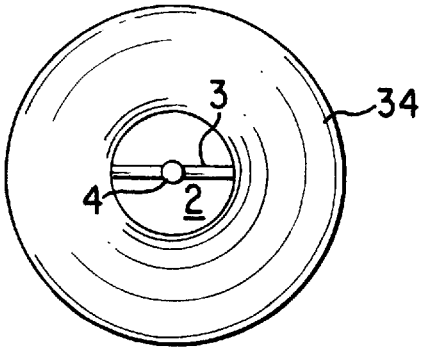
Figure 5C:
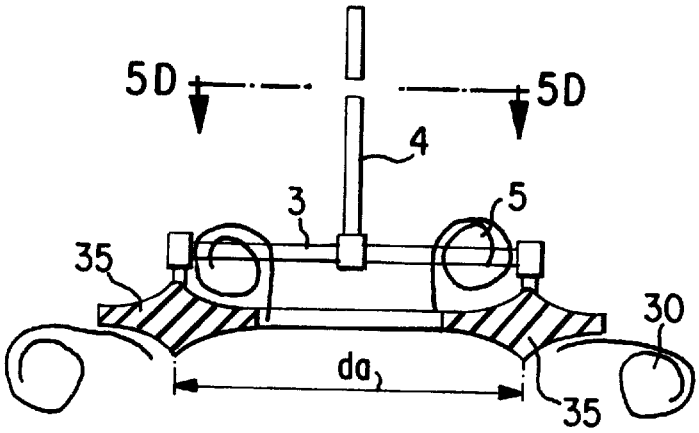
Figure 5D:
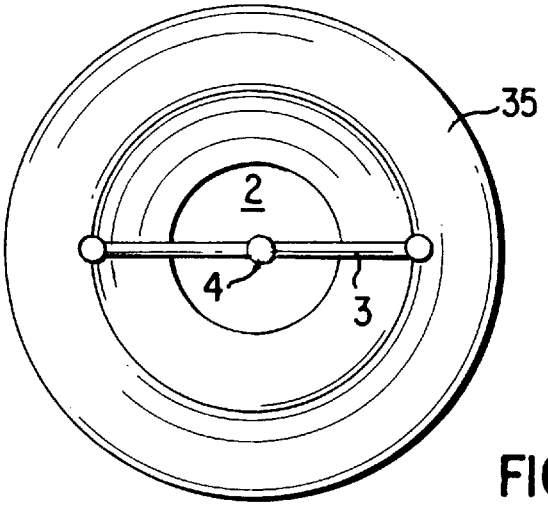
Figure 6A:
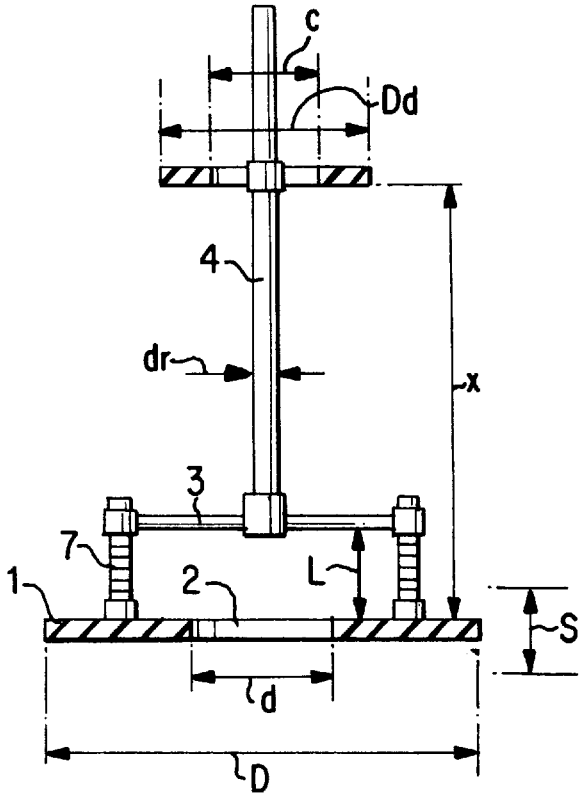
FIGS. 6*a* and 6*b* show the various pertinent geometric parameters for a generator plate vortex ring mixer and in particular a central drive shaft vortex ring mixer.
Figure 6B:
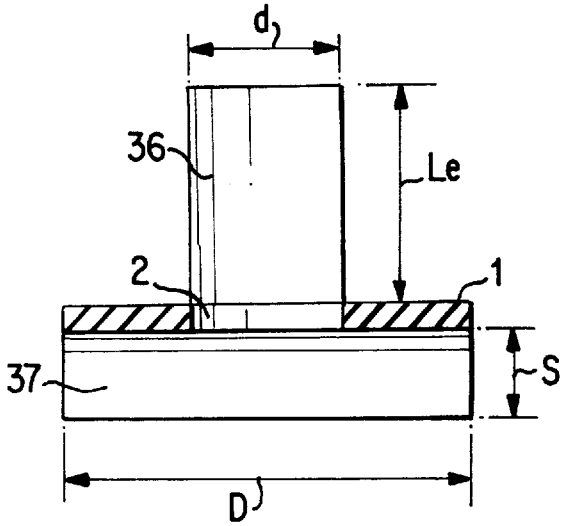

Another form of the invention is shown in FIG. 5*b*. This invention has a contoured generator plate 35. It may have only contours on either of the upper or lower surfaces or on both upper and lower surfaces. The best form of the contour in section as shown would be cylindrical or elliptical since a vortex ring is an oblate spheroid which is a form of an ellipsoid of revolution. The diameter da of the location of the apex of the curves is dependant on the ratio of the fluid to be ejected through the orifice to that ejected radially. For a shallow mixing vessel the apex will have a smaller diameter than for a deep mixing vessel when a more energetic vortex ring is required to travel tot he surface of the liquid. However, if a limited mixing zone is required the diameter of the apex can be adjusted accordingly.

Referring to FIGS. 4*a* and 4*b* there is disclosed a most preferred form of the invention, wherein, the diameter of the generator plate 1 is 'D' with the orifice 2 diameter 'd'. The stroke or half cycle motion of the drive shaft is 's'. When the generator plate moves through a stroke of length 's', the volume of fluid displaced 31 is given by $D^2s/4$. The slug of fluid ejected through the orifice 2, if all of the fluid displaced passes through the orifice, is $\pi d^2Le/4$. Therefore, the equivalent slug length, 'Le', of fluid ejected from the orifice by virtue of the distance the plate moves through the fluid 's' is given by: $Le=(D^2/d^2)s$. In actual fact there is some loss of fluid radially at the peripheral of the plate 1, which often manifested as ring type vortex rings 30. If 'η' is the fraction of volume of fluid displaced which actually passes through the orifice. Then Le is given by: $Le=\eta(D^2/d^2)s$ where 'η' is dependent on the geometry of the generating plate, orifice geometry orifice to plate diameter ratio d/D, and the generating plate motion characteristics.

An important parameter which reflects the criteria for efficient production of vortex rings is the 'Le/d' ratio, 'ϵ', given by, $\epsilon=Le/d=\eta(D/d)^2s/d$. If the parameter 'ϵ' is too large then there is a possibility of more than one vortex ring being generated, consequent vortex ring interactions, a reduction in the effectiveness of the propagation of vortex rings and, thus, a reduction in the efficiency of the mixing process. Also, if ϵ is too large then the discharge through the orifice is a jet which is not an efficient manner to produce a vortex ring.

The length 'L' shown in FIG. 4*a* affects the decay rate of a vortex ring, since if L is zero then a ring as it is generated immediately encounters the support spider and the drive shaft. However if L is greater than zero a vortex ring can be formed without encountering the support spider or at least only partially encountering the support spider and then the affects of the drive shaft are delayed. The diameter of the drive shaft 'dr' also affects the rate of decay of a vortex ring as it passes along the drive shaft. If the diameter 'dr' is sufficiently large compared with the orifice diameter 'd' then the rate of decay of a vortex ring can be relatively rapid and no disruptors may be necessary. However, a large diameter drive shaft 4 may be undesirable due to such factors as size, weight, and power consumption.

The location of a disruptor or disruptor group at a distance X along the drive shaft will affect the position of termination of a vortex ring or its zone of mixing. If stratification of the fluid being mixed is desirable then the position of a disruptor X can be accordingly adjusted. This effect is also affected by the length L where the support spider begins, since the affect of the diameter of the drive shaft 'dr' will be delayed when L is large relative to the diameter 'dr'.

When toriodal disruptor plates are used the outside diameter Dd and the inside diameter of the hole 'c' have an affect on the motion of a vortex ring when it encounters the disrupter. When 'c' is large compared with 'd' then a vortex ring will pass virtually unhindered through the orifice. However, when 'c' is relatively smaller than 'd' the disrupter will appear to be almost a solid disruptor to the vortex ring passage. A combination of a solid disruptor plate of relatively small diameter prior to an toriodal disrupter is very effective in terminating and controlling the destruction of a vortex ring while keeping the drag on the drive shaft relatively low.

The various forms of the disruptors 17, 20, 21, 22, 23, 24, 25, 26, 27, 28, 23 plus 24, and 29 are to control the motion of vortex rings as they progress along, or parallel to, the drive shaft(s) 5, to control the mixing process, and to create fluid convection and circulation. It has been found that when the diameter of a solid disruptor Dd is about 1.5 times the orifice diameter d, a vortex ring which is traveling along the drive shaft will travel radially when it encounters the disruptor. If Dd<1.5 d then the ring will be disrupted but continue to travel but with a lower forward velocity and larger diameter than prior to encountering the disrupter. This is useful when it is desirable not to cause undue liquid surface agitation, such as for paint agitation when there must be no gas uptake.

The upper surface of a disruptor plate may be flat or may be convex or conical, as shown by 20, 23 and 28 to avoid a buildup of sediment on the upper surface, and to reduce friction drag when the disrupter is firmly attached to the drive shaft. Alternatively, flexible disruptors 29 may be used to reduce drag on their motion and create radial vortex rings whilst still avoiding sedimentary material buildup on its surface.

The various forms of the hollow drive shaft permit the introduction of granular or powdered solids, liquids or gases in a controlled efficient manner. The various forms of the nozzles or orifices can be located anywhere along the drive shaft or have a contiguously perforated drive shaft surface for a distributed injection or extraction of the fluid being mixed. Also an extension of the drive shaft can be used as in FIG. 2*e*. Furthermore, the support spider may be a continuation of the hollow drive shaft and thus permit the ejection or extraction of materials at 15 or at any point along the support spider or continuously along the support spider.

The drive shaft orifices may also be used to extract fluids from the media being mixed. This is particularly useful for sealed mixing vessels and for reacting fluids and/or solids. The ability to choose the location of the orifice is useful for reacting materials when it may be desirable to extract reacted materials from specific regions within the fluid in the mixing vessel.

What is claimed is:

1. An improved vortex ring mixer for mixing fluids comprising a reciprocate central drive shaft having drive means associated therewith, to which is secured a generator plate having an orifice for generating vortex rings for mixing fluids, the drive shaft being centrally located with resect to the orifice of the vortex rind generator plate, the shaft being of sufficient diameter and being spaced vertically from the generator plate so as to disrupt the vortex rings generated by the generator plate by expanding and decelerating them upon contact thereby promoting additional fluid mixing.

2. The improved mixer as claimed in claim 1 wherein the drive shaft includes additional means for disrupting vortex rings.

3. The improved mixer as claimed claim 2 wherein the additional means for disrupting vortex rings comprises a disruptor plate attached to the drive shaft at a selected location for controlling the motion and regions of mixing.

4. The improved mixer as claimed in claim 2 wherein the additional means for disrupting vortex rings comprises a bouyant disruptor plate attached to the central drive shaft which is free to move along the drive shaft over a specific length of the drive shaft.

5. The improved mixer as claimed in claim 2 wherein the central drive shaft has one or more flexible disruptor plates which are attached to the drive shaft.

6. The improved mixer as claimed in claim 2 wherein the central drive shaft has one or more flexible disruptor plates, which are free to move along the drive shaft.

7. The improved mixer as claimed in claim 1 wherein the mixer includes means for adding material to be mixed whereby it is carried by a vortex ring into the fluid to be mixed.

8. The improved mixer as claimed in claim 7 wherein the central drive shaft is hollow with at least one orifice for the introduction of material to the fluid being mixed, and the at least one orifice is located at a position where the material introduced can be carried by a vortex ring into the fluid to be mixed.

9. The improved mixer as claimed in claim 1 wherein the generator plate is secured to the drive shaft with a drive spider.

10. The improved mixer as claimed in claim 9 wherein the drive spider is attached to the generator plate by legs.

11. The improved mixer as claimed in claim 1 wherein the central drive shaft is a solid body.

12. The improved mixer as claimed in 1 wherein the generator plate is flexible.

13. The improved mixer as claimed in 12 wherein the flexible generator plate is attached to and driven by an inner toriodal drive ring.

14. The improved mixer as claimed in 12 wherein the flexible generator plate is attached to and driven by an outer toriodal drive ring.

15. The improved mixer as claimed in 1 wherein the generator plate has a contoured surface.

16. The improved mixer as claimed in claim 1 wherein the central drive shaft has a finned reinforcement for added structural strength.

* * * * *